US012398629B2

(12) United States Patent
Brown

(10) Patent No.: US 12,398,629 B2
(45) Date of Patent: Aug. 26, 2025

(54) SIDE POCKET MANDREL WITH RETRIEVABLE REDUNDANT ELECTRIC GAS LIFT VALVE

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/136,796

(22) Filed: Apr. 19, 2023

(65) Prior Publication Data

US 2024/0352837 A1 Oct. 24, 2024

(51) Int. Cl.

| | |
|---|---|
| ***E21B 43/12*** | (2006.01) |
| ***E21B 34/06*** | (2006.01) |
| ***E21B 34/10*** | (2006.01) |
| ***E21B 41/00*** | (2006.01) |

(52) U.S. Cl.

CPC ..... *E21B 43/123* (2013.01); *E21B 34/066* (2013.01); *E21B 41/0035* (2013.01); *E21B 34/10* (2013.01)

(58) Field of Classification Search

CPC .... E21B 33/1294; E21B 47/13; E21B 43/123; E21B 2200/02; E21B 23/03; E21B 43/12; E21B 34/066; E21B 34/10

See application file for complete search history.

(56) References Cited

U.S. PATENT DOCUMENTS

| | | | |
|---|---|---|---|
| 2,649,272 | A | 8/1953 | Barbato |
| 2,845,940 | A | 8/1958 | Garrett et al. |
| 2,942,671 | A | 6/1960 | Josephine |
| 3,160,113 | A | 12/1964 | Meyers |
| 3,646,953 | A | 3/1972 | Elliott et al. |

(Continued)

FOREIGN PATENT DOCUMENTS

| | | | | |
|---|---|---|---|---|
| EP | 2666957 | A2 | 11/2013 | |
| WO | WO-9806928 | A1 * | 2/1998 | ..... E21B 34/066 |

(Continued)

OTHER PUBLICATIONS

Botil; Gas Lift Equipment Catalogue; www.botilindia.com; date unknown.

(Continued)

*Primary Examiner* — Zakiya W Bates

(74) *Attorney, Agent, or Firm* — Baker Hughes Patent Organization

(57) ABSTRACT

A side pocket mandrel for use within a gas lift system has a central body that includes a central bore and a valve pocket that is offset from the central body. The valve pocket includes a power landing in the valve pocket and configured to provide an electrical connection to the electric gas lift valve and a conductor connected to the power landing and configured to provide electric power to the power landing. The side pocket mandrel further includes a pneumatic gas lift valve installed within the valve pocket and an electric gas lift valve installed within the valve pocket. The electric gas lift valve and pneumatic gas lift valve can be installed or retrieved from the valve pocket using wireline-based tools without removing the side pocket mandrel from the well.

15 Claims, 4 Drawing Sheets

(56) References Cited

U.S. PATENT DOCUMENTS

| | | | |
|---|---|---|---|
| 3,654,949 | A | 4/1972 | McMurry |
| 3,863,961 | A | 2/1975 | Dinning |
| 3,874,445 | A | 4/1975 | Terral |
| 3,888,273 | A | 6/1975 | Douglas |
| 4,033,409 | A | 7/1977 | Hebert |
| 4,135,576 | A | 1/1979 | Tausch |
| 4,146,091 | A | 3/1979 | Terral |
| 4,265,306 | A | 5/1981 | Stout |
| 4,295,795 | A | 10/1981 | Gass et al. |
| 4,295,796 | A | 10/1981 | Moore |
| 4,333,527 | A | 6/1982 | Higgins et al. |
| 4,437,487 | A | 3/1984 | Marmon |
| 4,505,331 | A | 3/1985 | Akkerman |
| RE32,441 | E | 6/1987 | Higgins et al. |
| 4,685,523 | A | 8/1987 | Paschal et al. |
| 4,722,393 | A | 2/1988 | Rumbaugh |
| 4,759,410 | A | 7/1988 | Benker et al. |
| 5,176,164 | A | 1/1993 | Boyle |
| 5,181,566 | A | 1/1993 | Barneck |
| 5,535,767 | A | 7/1996 | Schnatzmeyer et al. |
| 5,597,042 | A | 1/1997 | Tubel et al. |
| 5,971,004 | A | 10/1999 | Pringle |
| 6,070,608 | A | 6/2000 | Pringle |
| 6,148,843 | A | 11/2000 | Pringle |
| 6,206,645 | B1 | 3/2001 | Pringle |
| 6,321,842 | B1 | 11/2001 | Pringle et al. |
| 6,375,155 | B1 | 4/2002 | Janssens |
| 6,679,332 | B2 | 1/2004 | Vinegar et al. |
| 6,715,550 | B2 | 4/2004 | Vinegar et al. |
| 6,722,632 | B2 | 4/2004 | Kenny et al. |
| 7,213,607 | B2 | 5/2007 | De |
| 7,228,909 | B2 | 6/2007 | Schmidt et al. |
| 7,658,229 | B2 | 2/2010 | Becker et al. |
| 7,793,727 | B2 | 9/2010 | Gaudette |
| 8,162,060 | B2 | 4/2012 | Randazzo |
| 8,453,736 | B2 | 6/2013 | Constantine |
| 8,714,264 | B2 | 5/2014 | Fay |
| 8,881,825 | B2 | 11/2014 | White et al. |
| 9,057,243 | B2 | 6/2015 | Hendel et al. |
| 9,453,397 | B2 | 9/2016 | Dowling et al. |
| 9,453,398 | B1 | 9/2016 | Zhang et al. |
| 9,587,463 | B2 | 3/2017 | Tveiten et al. |
| 10,655,439 | B2 | 5/2020 | Murdoch et al. |
| 10,677,028 | B2 | 6/2020 | Oliphant |
| 10,787,889 | B2 | 9/2020 | Salihbegovic et al. |
| 10,830,012 | B2 | 11/2020 | Holmes et al. |
| 11,578,569 | B2 | 2/2023 | Rodger |
| 11,851,988 | B2 | 12/2023 | Newton et al. |
| 2001/0017157 | A1 | 8/2001 | Pringle |
| 2002/0020533 | A1 | 2/2002 | Tubel |
| 2002/0029883 | A1 | 3/2002 | Vinegar et al. |
| 2003/0042026 | A1* | 3/2003 | Vinegar ..... E21B 33/1294 166/387 |
| 2007/0181312 | A1 | 8/2007 | Kritzler et al. |
| 2007/0227739 | A1 | 10/2007 | Becker et al. |
| 2011/0083855 | A1 | 4/2011 | Wygnanski |
| 2012/0292034 | A1 | 11/2012 | Fay |
| 2013/0146155 | A1 | 6/2013 | Gilbertson et al. |
| 2013/0220599 | A1 | 8/2013 | Rae |
| 2014/0352982 | A1 | 12/2014 | White et al. |
| 2016/0290099 | A1 | 10/2016 | Balasubramanian |
| 2020/0011155 | A1 | 1/2020 | Stamm et al. |
| 2020/0032592 | A1 | 1/2020 | Romer et al. |
| 2020/0256144 | A1 | 8/2020 | Deville et al. |
| 2022/0186587 | A1 | 6/2022 | Newton et al. |
| 2022/0220834 | A1 | 7/2022 | Brown et al. |
| 2023/0399927 | A1* | 12/2023 | Martinez ..... E21B 34/10 |
| 2024/0052730 | A1 | 2/2024 | Balasubramanian et al. |

FOREIGN PATENT DOCUMENTS

| | | | |
|---|---|---|---|
| WO | WO-0165067 A1 * | 9/2001 | ..... E21B 33/1294 |
| WO | 2004031529 A2 | 4/2004 | |
| WO | 2014022121 A1 | 2/2014 | |
| WO | 2016049726 A1 | 4/2016 | |
| WO | 2020212726 A1 | 10/2020 | |
| WO | 2022173815 A1 | 8/2022 | |

OTHER PUBLICATIONS

"MMRG Series Side Pocket Mandrels", Schlumberger, MMRG Series Side Pocket Mandrels, Sales Brochure, 2015.

"Side Pocket Mandrels", Parveen Industries Pvt. Ltd., Side Pocket Mandrels; www.parveen.in/products/side-pocket-mandrels; webpage captured Jul. 29, 2022.

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

Schnatzmeyer, M.A. , et al., "Development of a Surface-Controlled Electric Gas-Lift Valve", Journal of Petroleum Technology, May 1, 1994, May 1, 1994.

International Search Report and Written Opinion for PCT/US2024/025281 mailed Sep. 18, 2024.

* cited by examiner

SIDE POCKET MANDREL WITH RETRIEVABLE REDUNDANT ELECTRIC GAS LIFT VALVE

FIELD OF THE INVENTION

This invention relates generally to the field of oil and gas production, and more particularly to a gas lift system that incorporates an improved gas lift module.

BACKGROUND

Gas lift is a technique in which pressurized gaseous fluids are used to reduce the density of the produced fluids to allow the formation pressure to push the less dense mixture to the surface. In annulus-to-tubing systems, pressurized gases are injected from the surface into the annulus, where the pressurized gases enter the tubing string through a series of gas lift valves. Alternatively, in tubing-to-annulus systems, pressurized gases are injected into the tubing string and discharged into the annulus, where the gases help to produce fluids out of the annulus.

The gas lift valves can be configured to automatically open when the pressure gradient between the annulus and the production tubing exceeds the closing force holding each gas lift valve in a closed position. In most installations, each of the gas lift mandrels within the gas lift system is deployed above a packer or other zone isolation device to ensure that liquids and wellbore fluids do not interfere with the operation of the gas lift valve. Increasing the pressure in the annulus above the packer will force the gas lift valves to open at a threshold pressure, thereby injecting pressurized gases into the production tubing or the annulus.

To permit the unimpeded production of wellbore fluids through the production tubing, the gas lift valves are housed within "side pocket mandrels" that include a valve pocket that is laterally offset from the production tubing. Because the gas lift valves are contained in these laterally offset valve pockets, tools can be deployed and retrieved through the open primary passage of the side pocket mandrel. The predetermined position of the gas lift valves within the production tubing string controls the entry points for gas into the production string.

A common problem in gas lift completions is the management of interventions required to accommodate unforeseen well operations. For example, while setting packers and testing tubing by increasing the pressure within the annulus, "dummy" valves are typically installed within the side pocket mandrels to prevent flow of completion fluids from the annulus into the production tubing, or from the production tubing into the annulus. Once the packers have been set, the dummy valves are replaced with types of gas lift valves that permit flow into the production string from the annulus.

As another example, when it becomes necessary to unload the well, the gas lift valves must be closed as the fluid level in the well drops to prevent the gas within the annulus from escaping through an open gas lift valve. This requires operators to plan the unloading sequence and valve parameters for a specific well given a set of assumed production parameters within the well. Because the operation of gas lift valves cannot be easily adjusted once the gas lift valves have been installed, typical gas lift systems cannot be easily adapted to changing production parameters within the well.

Moreover, there is a growing market for electric completions and a desire to electrify gas lift systems, with an option for continuing to use traditional gas lift valves that can be retrieved using conventional wireline-based systems. There is, therefore, a need for an improved gas lift system that overcomes these and other deficiencies in the prior art.

SUMMARY OF THE INVENTION

In some embodiments, the present disclosure is directed to a side pocket mandrel for use within a gas lift system that has been deployed in a well that has an annulus surrounding the gas lift system. The side pocket mandrel includes a central body that includes a central bore, a valve pocket that is offset from the central body and central bore, a pneumatic gas lift valve installed within the valve pocket, and an electric gas lift valve installed within the valve pocket. The electric gas lift valve and pneumatic gas lift valve are both retrievable using wireline-based tools.

In another embodiment, the present disclosure is directed to a side pocket mandrel for use within a gas lift system that has been deployed in a well that has an annulus surrounding the gas lift system. The side pocket mandrel has a central body that includes a central bore and a valve pocket that is offset from the central body and central bore. The valve pocket includes a power landing in the valve pocket that is configured to provide an electrical connection to the electric gas lift valve. A conductor connected to the power landing provides a source of electric power. The side pocket mandrel includes a pneumatic gas lift valve installed within the valve pocket and an electric gas lift valve installed within the valve pocket. The electric gas lift valve and pneumatic gas lift valve are linearly aligned in the valve pocket. The electric gas lift valve is connected to the power landing and retrievable using a wireline-based tool without removing the side pocket mandrel from the well.

In yet other embodiments, the present disclosure is directed at a side pocket mandrel for use within a gas lift system deployed in a well that has an annulus surrounding the gas lift system. The side pocket mandrel has a central body that includes a central bore, a first valve pocket that is offset from the central body, and a second valve pocket that is offset from the central body. The second valve pocket is arranged in a side-by-side relationship with the first valve pocket. The first valve pocket includes a power landing in the valve pocket that is configured to provide an electrical connection to the electric gas lift valve. A conductor is connected to the power landing to provide electric power to the power landing. The side pocket mandrel includes an electric gas lift valve connected to the power landing within the first valve pocket and a pneumatic gas lift valve installed within the second valve pocket. The electric gas lift valve and pneumatic gas lift valve are both retrievable using wireline-based tools.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells. References to "lateral" positions should be interpreted as laterally offset from an axis or component extending in a substantially vertical orientation.

Figure 1:
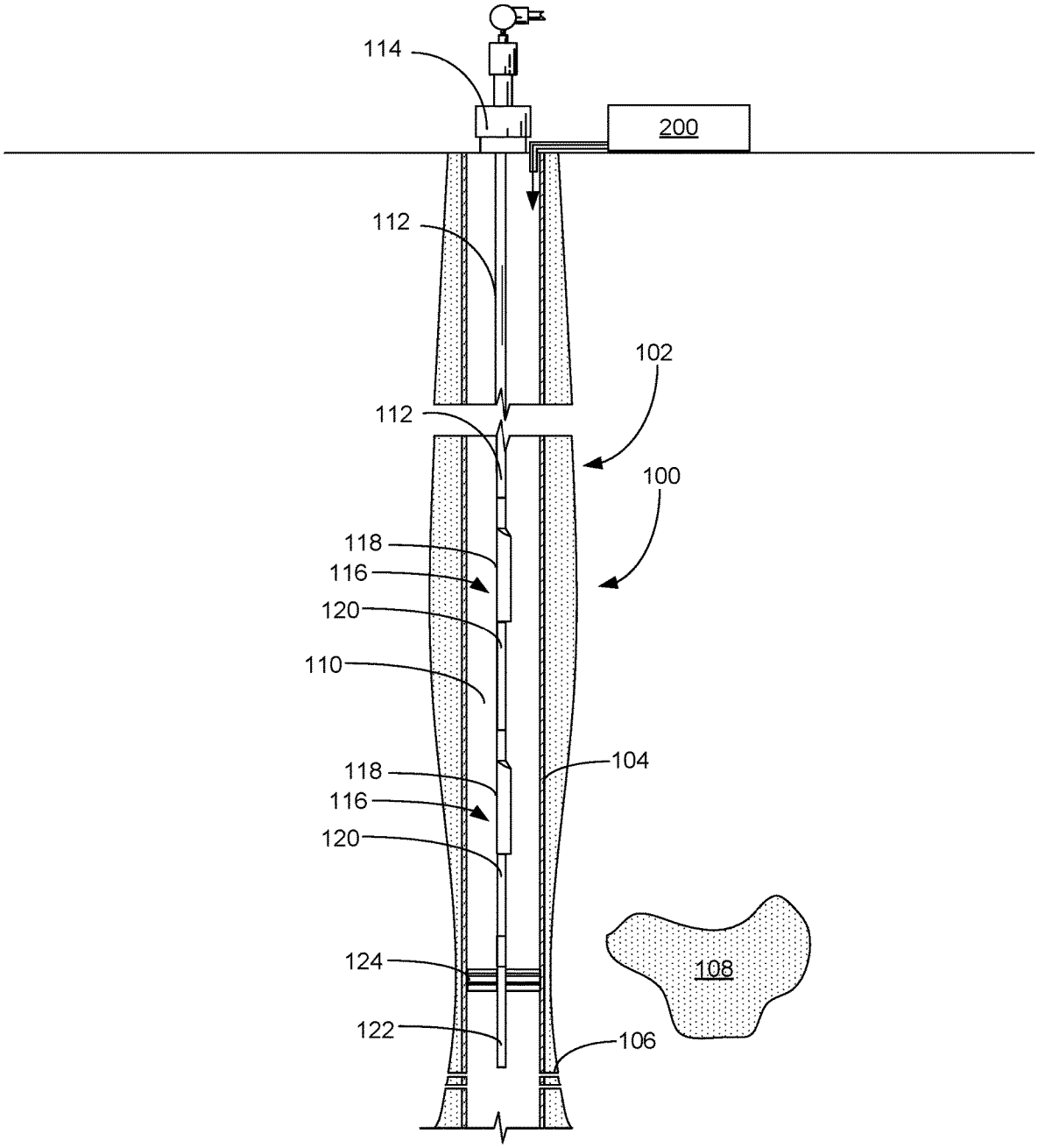
FIG. 1 is a side view of a gas lift system deployed in a conventional well.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annulus 110 is formed between the gas lift system 100 and the casing 104. The gas lift system 100 is connected to production tubing 112 that conveys produced wellbore fluids from the formation 108, through the gas lift system 100, to a wellhead 114 on the surface.

The gas lift system 100 includes one or more gas lift modules 116. The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the production tubing 112, which conveys the produced fluids through the wellhead 114 to surface-based storage or processing facilities.

In accordance with well-established gas lift principles, pressurized fluids or gases are injected from a gas supply 200 on the surface into the annulus 110 surrounding the gas lift system 100. The gas lift modules 116 controllably admit the pressurized gases into the production tubing 112 through the side pocket mandrel 118. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as in unloading water-based fluids from the well 102.

Figure 2A:
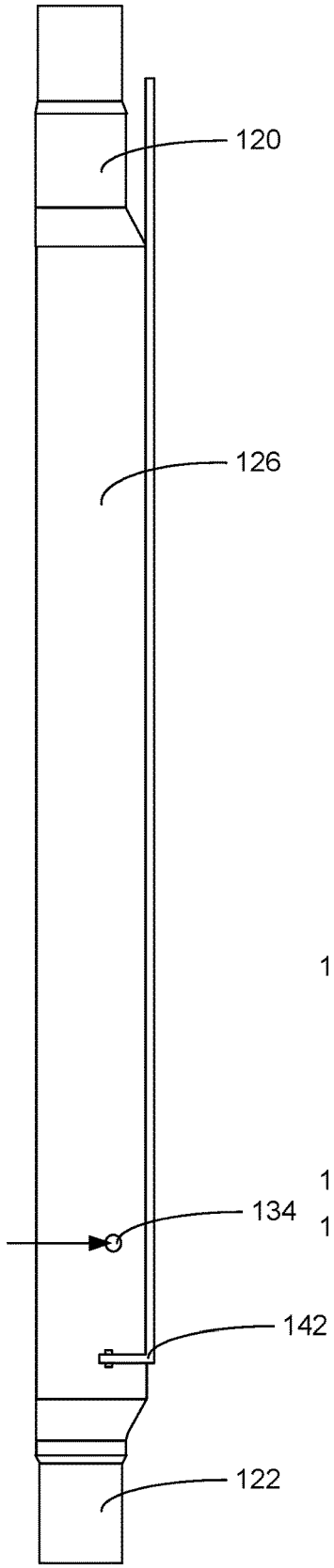
FIGS. 2A-2C are side and partial cross-sectional views of a side pocket mandrel constructed in accordance with a first embodiment of the invention.
Figure 2B:
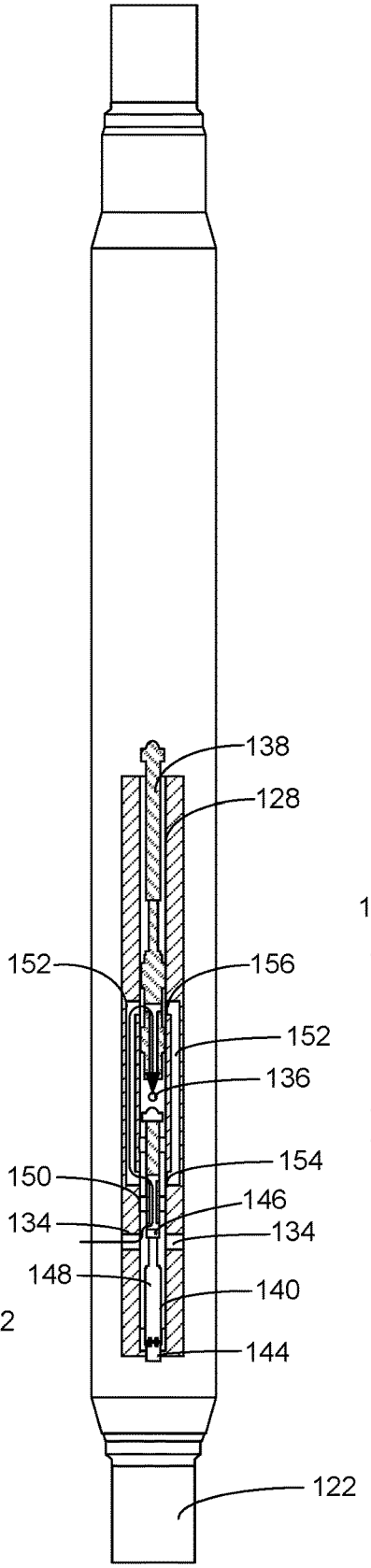
Figure 2C:
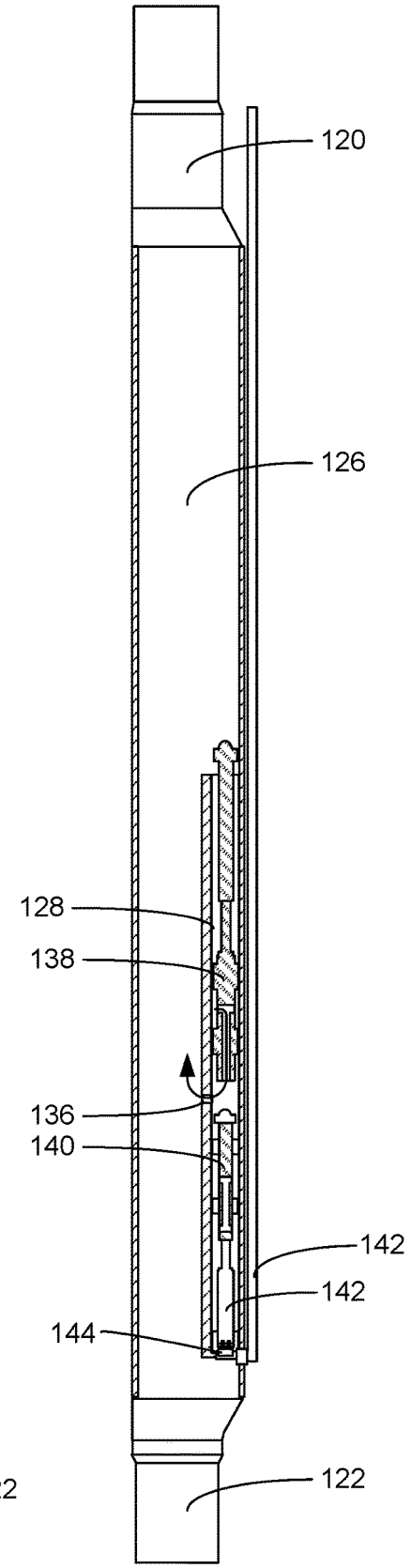
Figure 3A:
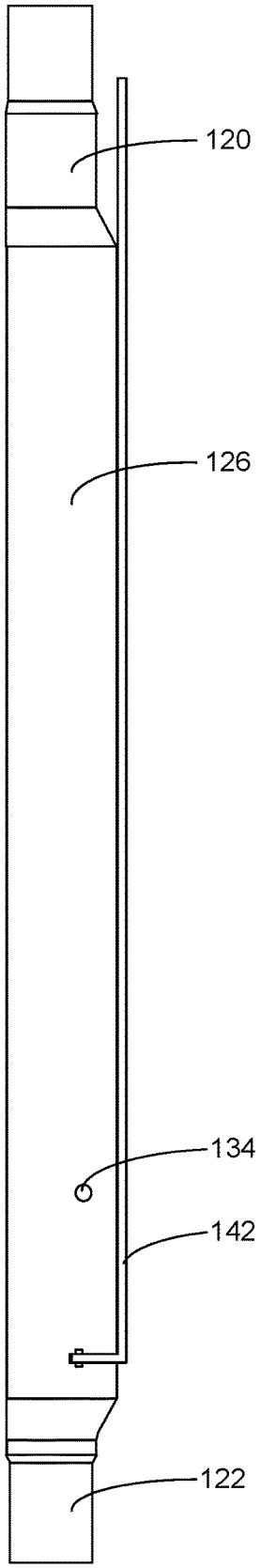
FIGS. 3A-3C are side and partial cross-sectional views of a side pocket mandrel constructed in accordance with a second embodiment of the invention.
Figure 3B:
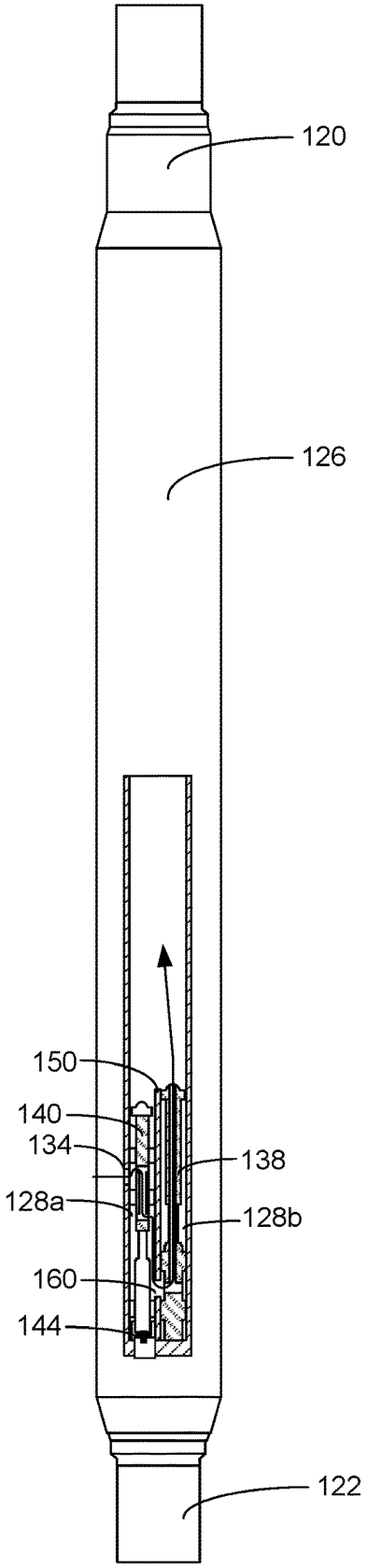
Figure 3C:
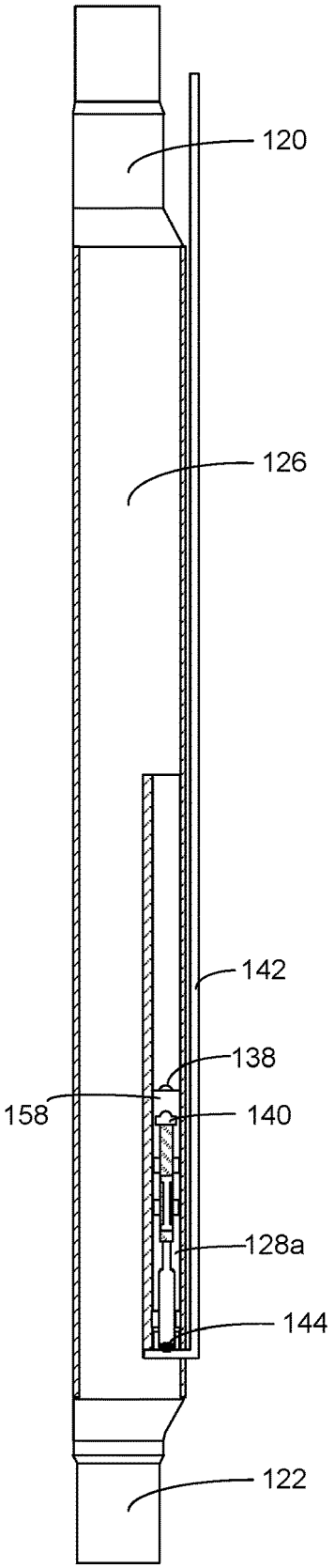
Figure 4A:
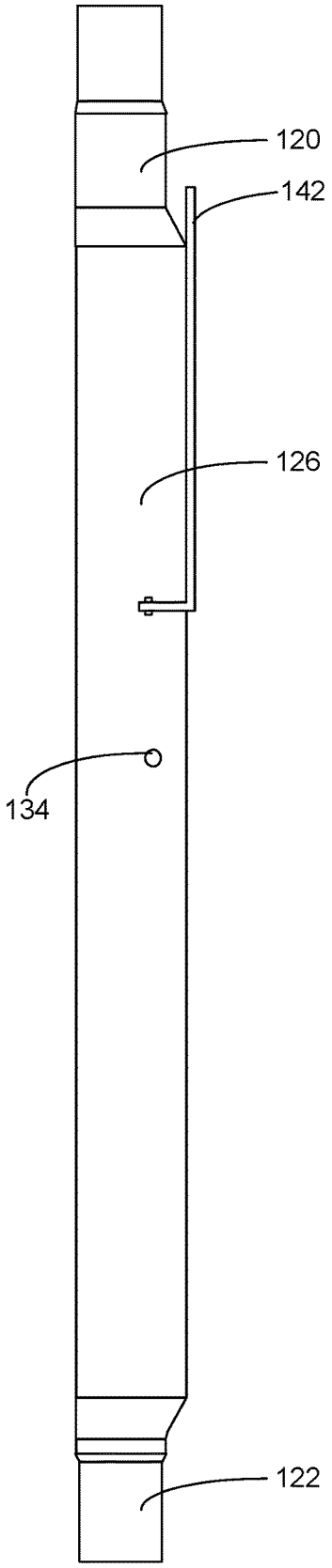
FIGS. 4A-4C are side and partial cross-sectional views of a side pocket mandrel constructed in accordance with a third embodiment of the invention.
Figure 4B:
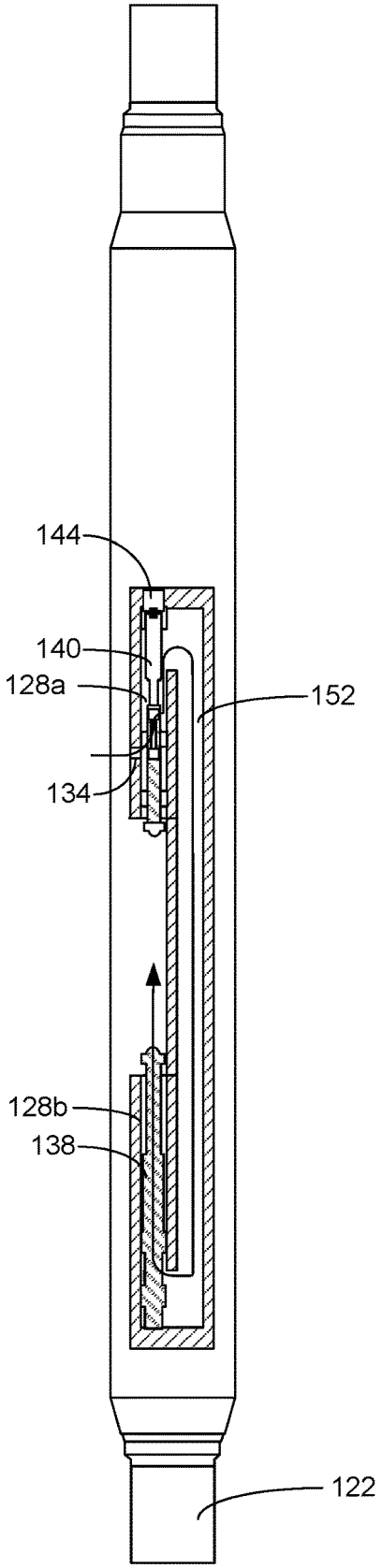
Figure 4C:
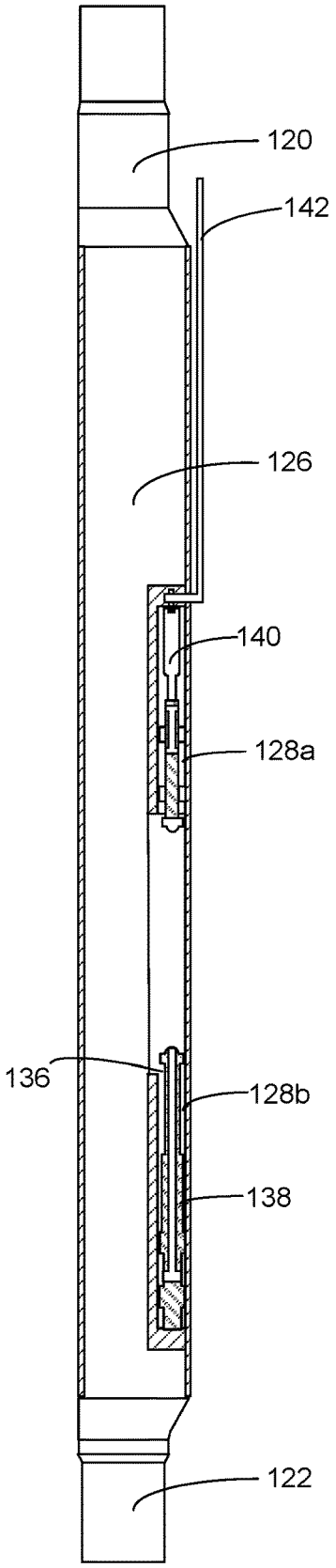

Turning to FIGS. 2A-4C, shown therein are side and partial cross-sectional depictions of the gas lift module 116 constructed in accordance with various embodiments. FIGS. 2A, 3A and 4A present side views of the side pocket mandrel 118. FIGS. 2B, 3B and 4B present partial cross-sectional views of the side pocket mandrel 118 rotated 90 degrees from the side pocket mandrel 118 depicted in FIGS. 2A, 3A and 4A. FIGS. 2C, 3C and 4C present partial cross-sectional views of the side pocket mandrels 118 depicted in FIGS. 2A, 3A and 4A. Except as indicated, the components and features of the side pocket mandrels 118 depicted in FIGS. 2A-4C are the same.

In each case, the side pocket mandrel 118 includes a central body 126 and a valve pocket 128 within the side pocket mandrel 118. The central body 126 includes a central bore 130. The valve pocket 128 is laterally offset and separated from the central bore 130, which extends in a substantially colinear fashion with the production tubing 112. An exterior port 134 provides a path from the annulus 110 into the valve pocket 128. An interior port 136 provides a path from the valve pocket 128 into the central bore 130 of the side pocket mandrel 118.

The valve pocket 128 contains a conventional pneumatic gas lift valve 138 and an electric gas lift valve 140. The pneumatic gas lift valve 138 is configured to be installed and retrieved using conventional wireline and kickover tools. The pneumatic gas lift valve 138 is configured to be actuated from open to closed positions in response to a sufficient pressure gradient. When the pressure gradient between an inlet and an outlet of the pneumatic gas lift valve 138 exceeds the closing force of the pneumatic gas lift valve 138, the gas is admitted through the pneumatic gas lift valve 138, in accordance with conventional gas lift valve mechanisms.

The electric gas lift valve 140 is connected to a suitable conductor 142 through a power landing 144 installed in the valve pocket 128. The conductor 142 can be a tubing encapsulated conductor (TEC) line that is configured to provide power and control signals from the surface to the electric gas lift valve 140. The power landing 144 can include a plug or socket that connects with a mating feature on the electric gas lift valve 140. The power landing 144 is designed to facilitate the connection and disconnection of the electric gas lift valve 140 from the side pocket mandrel 118 while the side pocket mandrel 118 remains in the well 102. Like the pneumatic gas lift valve 138, the electric gas lift valve 140 is also configured to be installed and retrieved using conventional wireline tools, such as a kickover tool. Because the electric gas lift valve 140 is retrievable, it can be replaced or serviced without removing the side pocket mandrel 118 from the well 102.

The electric gas lift valve 140 can be actuated at any position from fully closed to fully opened to control the flow and flow rate of gases through the electric gas lift valve 140. In some embodiments, the electric gas lift valve 140 includes an internal valve member 146 that controls the passage of fluid through the electric gas lift valve 140. The valve member 146 is driven by a motorized actuator 148 that is in electric communication with the power landing 144. In some embodiments, the actuator 148 is a linear actuator that moves the valve member 146 on and off a valve seat 150. In other embodiments, the actuator 148 is a rotary actuator that rotates the valve member 146 into or out of alignment with passages extending through the valve seat 150.

The actuator 148 operates in response to a command signal carried by the conductor 142 from the surface or other downhole equipment using standard downhole communication protocols and modalities, including wireless RF, acoustic (pressure pulse) and wired. In exemplary embodiments, the gas lift system 100 includes a plurality of gas lift modules 116, which each include an electric gas lift valve 140 that can be independently controlled apart from the other electric gas lift valves 140 within the gas lift system 100. This permits the operator to selectively place one or more of the plurality of gas lift modules 116 in an open state while keeping other gas lift modules 116 in a closed state.

In FIGS. 2A-2C, the side pocket mandrel 118 includes an elongated valve pocket 128 that is designed to contain both the electric gas lift valve 140 and the pneumatic lift valve 138 arranged in a linear end-to-end relationship. In the embodiment depicted in FIGS. 2B and 2C, the electric gas lift valve 140 is positioned below (downhole) from the pneumatic gas lift valve 138. The side pocket mandrel 118 includes a lateral passage 152 that runs alongside and adjacent to one or both sides of the valve pocket 128. The lateral passage 152 includes one or more inlets 154 and one or more outlets 156. The inlets 154 provide a path from the discharge of the electric gas lift valve 140 in the valve pocket 128 into the lateral passage 152. The outlets 156 provide path from the lateral passage 152 back into the valve pocket 128 adjacent the inlet to the pneumatic gas lift valve 138.

In this way, gas from the annulus 110 enters the valve pocket 128 through the exterior port 134, where it passes through the electric gas lift valve 140 when the electric gas lift valve 140 is not placed in the "closed" position. The gas is discharged from the open electric gas lift valve 140 into the valve pocket 128, where it is forced into the lateral passage 152. The gas returns from the lateral passage 152 to the valve pocket 128 adjacent the pneumatic gas lift valve 138. If the pressure gradient across the pneumatic gas lift valve 138 is sufficiently high, the pneumatic gas lift valve 138 will open and the gas will pass through the pneumatic gas lift valve 138 before entering the central bore 130 through the interior port 136. In this configuration, the electric gas lift valve 140 acts as a controllable choke that can be used to block or permit the flow of gases into the valve pocket 128 through the exterior port 134.

During a retrieval operation, the pneumatic gas lift valve 138 is removed first using a wireline-based tool. Once the pneumatic gas lift valve 138 has been removed, the electric gas lift valve 140 can be retrieved from the valve pocket 128 using a wireline-based tool. The installation process is carried out in reverse order. The electric gas lift valve 140 is installed into the valve pocket 128 with a wireline-based tool before the pneumatic gas lift valve 138 is installed in the valve pocket 128 above the electric gas lift valve 140.

In the embodiment depicted in FIGS. 3A-3C, the valve pocket 128 is separated by a divider 158 into first and second valve pockets 128*a*, 128*b* (as best illustrated in FIG. 3B). The divider 158 includes a passthrough passage 160 that connects the first and second valve pockets 128*a*, 128*b*. The electric gas lift valve 140 and power landing 144 are located in the first valve pocket 128*a* while the pneumatic gas lift valve 138 is located in the second valve pocket 128*b*. In this configuration, the pneumatic gas lift valve 138 and the electric gas lift valve 140 are oriented in a side-by-side configuration that also permits the retrieval and installation of the pneumatic gas lift valve 138 and electric gas lift valve 140 using conventional wireline-based tools.

The exterior port 134 intersects the first valve pocket 128*a* and the interior port 136 places the second valve pocket 128*b* in fluid communication with the central bore 130. In this configuration, the electric gas lift valve 140 controllably regulates the flow of gas from the annulus 110 through the first valve pocket 128*a* to the passthrough passage 160, where the gas is injected into the second valve pocket 128*b*. If the pressure of the gas in the second valve pocket 128*b* is sufficiently high, the pneumatic gas lift valve 138 will open to allow the pressurized gas to pass through the pneumatic gas lift valve 138 into the central bore 130 through the interior port 136 or an open end of the second valve pocket 128*b*.

Turning to FIGS. 4A-4C, shown therein is an embodiment in which the electric gas lift valve 140 is located above the pneumatic gas lift valve 138. In this embodiment, the side pocket mandrel 118 includes first and second valve pockets 128*a*, 128*b*, that are linearly arranged with the first valve pocket 128*a* located at an upper end of the side pocket mandrel 118 and the second valve pocket 128*b* located at a lower end of the side pocket mandrel 118. The first and second valve pockets 128*a*, 128*b* are connected to another by the lateral passage 152.

In some embodiments, the electric gas lift valve 140 is secured in the first valve pocket 128*a* and the pneumatic gas lift valve 138 is secured in the second valve pocket 128*b* (as depicted in FIGS. 4B-4C). In this configuration, the electric gas lift valve 140 controls the passage of gas from the annulus 110 into the valve pocket 128*a* and lateral passage 152, while the pneumatic gas lift valve 138 provides redundant access from the valve pocket 128*b* into the production tubing 112. During use, gas enters the first valve pocket 128*a* through the exterior port 134. If the electric gas lift valve 140 is not in the closed position, the gas passes through the electric gas lift valve 140 into the lateral passage 152, before entering the lower end of the second valve pocket 128*b*. If the pressure of the gas is sufficiently high, the pneumatic gas lift valve 138 opens and allows the pressurized gas to pass through the pneumatic gas lift valve 138 into the central bore 130 in an upward, forward flow direction. In this embodiment, the pneumatic gas lift valve 138 and the electric gas lift valve 140 can each be retrieved or installed using a kickover tool or other wireline-based tools.

Although the embodiments depicted in FIGS. 2A-4C have been illustrated and described in connection with an annulus-to-tubing system, the same embodiment can also be used in connection with a tubing-to-annulus system in which pressurized gas is injected into the production tubing 112 and discharged through the gas lift module 116 into the annulus 110.

The ability to selectively enable and disable the electric gas lift valve 140 significantly improves the versatility of the gas lift system 100 by allowing the operator to respond to a condition in which preventing the flow of fluids between the valve pocket 128 and the central bore 130 is desirable. For example, while the well 102 is being unloaded of excess fluid in the annulus 110, the electric gas lift valve 140 can be activated to selectively disable the pneumatic gas lift valve 138 in a gas lift module 116 that is no longer under the liquid level in the annulus 110. Without the ability to selectively disable the pneumatic gas lift valve 138 within the gas lift module 116, pressure within the annulus 110 would tend to escape through the "dry" gas lift module 116, thereby decreasing the efficiency of the unloading operation. In this way, the electric gas lift valve 140 enables the operator to only open those gas lift modules 116 that are useful in unloading the well 102.

Moreover, the electric gas lift valve 140 permits the selective isolation of the pneumatic gas lift valve 138 from the annulus 110 with an electric on-demand system, while permitting the retrieval and installation of the pneumatic gas lift valve 138 and electric gas lift valve 140 using conventional wireline-based tools (including standard kickover tools). In this way, the embodiments disclosed herein can be configured for use in a method for servicing the gas lift system 100 by actuating the electric gas lift valve 140 in the side pocket mandrel 118 to isolate the pneumatic gas lift valve 138 from the annulus 110, and then removing the pneumatic gas lift valve 138 with a wireline-based tool. The method can further include installing a second gas lift valve into the valve pocket 128 with a wireline-based tool before placing the electric gas lift valve 140 in an open state to communicate fluid from the annulus 110 to the newly installed gas lift valve.

Thus, in exemplary embodiments, the side pocket mandrel 118 includes a pneumatic gas lift valve 138 and an electric gas lift valve 140 that can be arranged within the side pocket mandrel 118 in linear end-to-end relationships or parallel side-by-by side relationships. The pneumatic gas lift valve 138 and the electric gas lift valve 140 can be configured to operate in a redundant manner in which gas must flow through both the pneumatic gas lift valve 138 and electric gas lift valve 140 before entering the central bore 130. The pneumatic gas lift valve 138 and the electric gas lift valve 140 can also be configured to operate in a parallel manner in which gas can reach the central bore 130 by flowing through either or both of the pneumatic gas lift valve 138 and electric gas lift valve 140. Importantly, the pneumatic gas lift valve 138 and electric gas lift valve 140 can be retrieved and installed using conventional wireline tools. The electric gas lift valve 140 is configured to be easily connected to the side pocket mandrel 118 through a connection with the power landing 144.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use within a gas lift system deployed in a well that has an annulus surrounding the gas lift system, the side pocket mandrel comprising:

a central body that includes a central bore;

a valve pocket that is offset from the central body;

a pneumatic gas lift valve installed within the valve pocket; and an electric gas lift valve installed within the valve pocket, wherein the electric gas lift valve is configured to be retrieved from the valve pocket separately from the pneumatic gas lift valve using a wireline-based tool.

2. The side pocket mandrel of claim 1, wherein the side pocket mandrel further comprises:

a power landing in the valve pocket and configured to provide an electrical connection to the electric gas lift valve; and a conductor connected to the power landing and configured to provide electric power to the power landing.

3. The side pocket mandrel of claim 2, wherein the electric gas lift valve and pneumatic gas lift valve are linearly aligned in the valve pocket.

4. The side pocket mandrel of claim 3, wherein the electric gas lift valve is positioned below the pneumatic gas lift valve within the valve pocket.

5. The side pocket mandrel of claim 4, wherein the side pocket mandrel further comprises a lateral passage adjacent to the valve pocket.

6. The side pocket mandrel of claim 5, wherein the lateral passage comprises an inlet connecting the lateral passage to the valve pocket proximate to the electric gas lift valve.

7. The side pocket mandrel of claim 6, wherein the lateral passage comprises an outlet connecting the lateral passage to the valve pocket proximate to the pneumatic gas lift valve.

8. The side pocket mandrel of claim 2, wherein the pneumatic gas lift valve is positioned below the electric gas lift valve within the valve pocket.

9. The side pocket mandrel of claim 8, wherein the side pocket mandrel further comprises a lateral passage adjacent to the valve pocket that places electric gas lift valve in fluid communication with the pneumatic gas lift valve.

10. The side pocket mandrel of claim 2, wherein the valve pocket comprises a divider that separates the valve pocket into a first valve pocket and a second valve pocket arranged in a side-by-side relationship.

11. The side pocket mandrel of claim 10, wherein the electric gas lift valve is secured in the first valve pocket and the pneumatic gas lift valve is secured in the second valve pocket.

12. A side pocket mandrel for use within a gas lift system deployed in a well that has an annulus surrounding the gas lift system, the side pocket mandrel comprising:

a central body that includes a central bore;

a valve pocket that is offset from the central body, wherein the valve pocket comprises:

a power landing in the valve pocket and configured to provide an electrical connection to the electric gas lift valve; and a conductor connected to the power landing and configured to provide electric power to the power landing;

a pneumatic gas lift valve installed within the valve pocket; and an electric gas lift valve installed within the valve pocket, wherein the electric gas lift valve and pneumatic gas lift valve are linearly aligned in the valve pocket and configured to be separately removed from the valve pocket.

13. The side pocket mandrel of claim 12, wherein the electric gas lift valve and pneumatic gas lift valve are both retrievable using wireline-based tools.

14. The side pocket mandrel of claim 13, wherein the electric gas lift valve is positioned below the pneumatic gas lift valve within the valve pocket.

15. The side pocket mandrel of claim 13, wherein the pneumatic gas lift valve is positioned below the electric gas lift valve within the valve pocket.

* * * * *